United States Patent [19]

Brakhage, Jr.

[11] Patent Number: 4,577,694

[45] Date of Patent: Mar. 25, 1986

[54] PERMANENT LOCK OPEN TOOL

[75] Inventor: William L. Brakhage, Jr., Broken Arrow, Okla.

[73] Assignee: Baker Oil Tools, Inc., Orange, Calif.

[21] Appl. No.: 565,380

[22] Filed: Dec. 27, 1983

[51] Int. Cl.[4] ..... E21B 34/06; E21B 23/00

[52] U.S. Cl. ..... 166/382; 166/323; 166/386

[58] Field of Search ..... 166/382, 386, 214, 323, 166/381, 373, 277, 207

[56] References Cited

U.S. PATENT DOCUMENTS

| | | | |
|---|---|---|---|
| 341,327 | 5/1886 | Fay | 166/207 |
| 1,380,182 | 5/1921 | Bigelow | 166/207 |
| 3,270,817 | 9/1966 | Papaila | 166/207 |
| 3,696,868 | 10/1972 | Taylor, Jr. | 166/322 |
| 3,786,866 | 1/1974 | Tausch et al. | 166/323 |
| 4,356,867 | 11/1982 | Carmody | 166/323 |
| 4,407,363 | 10/1983 | Akkerman | 166/323 |

*Primary Examiner*—Stephen J. Novosad
*Assistant Examiner*—Bruce M. Kisliuk
*Attorney, Agent, or Firm*—Norvell & Associates

[57] ABSTRACT

A method and apparatus for permanently locking a shiftable valve member in a well conduit in an open position is provided by permitting a spring metal band to expand from a contracted, run-in position to a radially enlarged locking position holding the shiftable valve member in an open position. Positioning lugs are additionally provided which are operable by upward movement of a mandrel to determine whether an actuating sleeve for the shiftable valve member is properly located in its position corresponding to the closed position of the valve so that it will not interfere with the operation of the expanding lock open band member. The tool can be used with a flow tube actuated flapper valve or with other conventional valves.

20 Claims, 8 Drawing Figures

PERMANENT LOCK OPEN TOOL

BACKGROUND OF THE INVENTION

1. FIELD OF THE INVENTION

The invention relates to a method and apparatus for permanently locking a shiftable valve member, such as a flapper valve, in an open position in a well conduit.

2. HISTORY OF THE PRIOR ART

In the operation of modern oil and gas wells, it often becomes desirable to permanently lock in an open position a shiftable valve member, such as a flapper valve, which is disposed in a well conduit. This is particularly necessary when it is desired to perform various well servicing operations through the valve and it is not contemplated that the valve will again be employed in subsequent operation of the well. It has previously been disclosed that valves, including rotatable ball type valves, may be held in an open position by shifting a retainer mechanism into engagement with an operating sleeve for the valve to prevent the return of the operating sleeve and valve to a closed position. See, for example, U.S. Pat. No. 3,696,868 to Taylor, Jr. This requires incorporation in the valve actuating mechanism of the retainer mechanism and thus complicates the total cost of the shiftable valve when initially installed in the well. In many cases, this cost is unjustified because the occasion never arises for locking the shiftable valve in an open position. Furthermore, the lock open mechanism is continuously subjected to subsurface well conditions during normal operations, and may be damaged, corroded or stuck in the retracted position, preventing subsequent actuation when necessary.

It would be desirable, therefore, to provide a method and apparatus for effecting the retention of a shiftable valve member within a well conduit in an open position by a mechanism which is entirely separate from the valve mechanism and which can be subsequently inserted in the well conduit only when it becomes necessary to permanently lock the shiftable valve member in an open position.

SUMMARY OF THE INVENTION

This invention provides a method and apparatus for effecting the locking in an open position of a shiftable valve member, such as a flapper or ball type valve normally mounted in a well conduit. The preferred embodiment of the invention may be used with a flapper valve which is actuated in conventional fashion by a reciprocating piston type sleeve.

This invention provides a latch in the form of a compressed cylindrical spring which can comprise a compressed C-ring or a spiral spring. The spring band is assembled on an inserting tool and peripherally compressed thereon. The spring band is held in such compressed position by a pair of axially shiftable retaining sleeves which respectively overlie the opposite axial ends of the compressed spring. The retaining sleeves are respectively spring biased to an axial position away from the compressed spring band but are respectively held in their retaining positions by two sets of locking lugs. The locking lugs are in turn maintained in their locking positions with respect to the retaining sleeves by a mandrel which is carried by the inserting tool.

An intermediate sleeve is provided on the insertion tool in surrounding relationship to the mandrel which is anchored to the well conduit by a conventional releasable latch which engages a no-go shoulder provided in the well conduit above the position of the shiftable valve member. The intermediate sleeve mounts the aforementioned locking lugs. The mandrel is provided with recessed external surfaces which can be moved into alignment with the retaining lugs by upward movement of the mandrel relative to the intermediate sleeve. Upon release of the retaining lugs, the spring biased sleeves move axially apart to concurrently release both edges of the contracted locking spring band. When run-in, the insertion tool pivots the flapper valve toward its open position. Since the no-go shoulder positions the spring band radially adjacent the shiftable valve member, such as a flapper valve, the locking spring band expands peripherally and forces the shiftable valve member outwardly to its outermost position, thus locking it in an open position without significantly reducing the internal fluid flow conduit. The insertion tool can then be released by conventional manipulation of the latch from the no-go shoulder, and removed from the well conduit so that the insertion tool can be reused merely by positioning another spring locking band on the intermediate sleeve.

It sometimes happens when an attempt is made to achieve the locking of the shuttle valve in its open position, that the actuating sleeve for the shuttle valve may be in its valve opening position, so that the release of the spring band would merely effect the engagement of the band with the interior of the actuating sleeve. To prevent this occurrence, a second set of radially shiftable positioning lugs are mounted in the intermediate sleeve for alignment just below the lower edge of the actuating sleeve when it is properly disposed in its closed position relative to the shiftable valve. The mandrel is provided with radially raised surfaces to engage the feeler lugs and thrust them outwardly at the beginning of the upward movement of the mandrel. If the actuating sleeve is in an improper position, the lugs will strike the bore of the sleeve and further upward movement of the mandrel will be prevented. A shear pin is provided between two axially connected components of the mandrel which will release under these conditions, and upon pulling the released portions of the insertion tool to the surface, the operator can then retrieve the remaining portions of the inserted tool and the still contracted locking spring band from the conduit. Accordingly, the faulty insertion of the locking spring band within the bore of an actuating sleeve is effectively prevented.

Further advantages of this invention will be readily apparent to those skilled in the art from the following detailed description, taken in conjunction with the annexed sheets of drawings, on which is shown a preferred embodiment of the invention.

DESCRIPTION OF THE PREFERRED EMBODIMENT

Figure 1A:
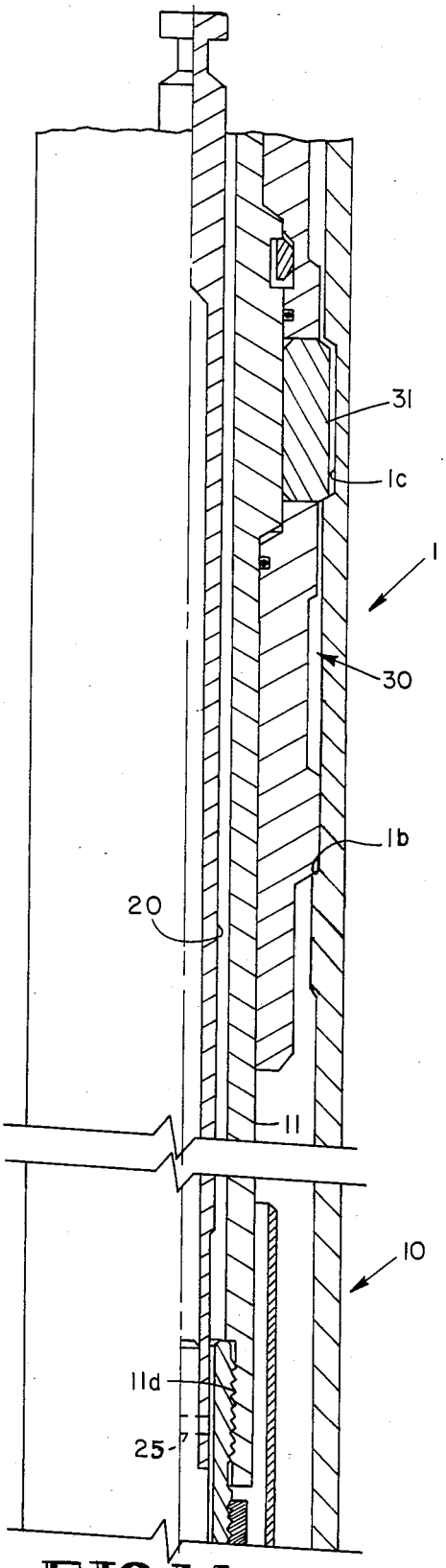
FIGS. 1A and 1B collectively represent a vertical quarter-sectional view of a well tool incorporating a flapper type safety valve, shown with a lock open tool disposed in a run-in position in alignment with the shiftable flapper valve.
Figure 1B:
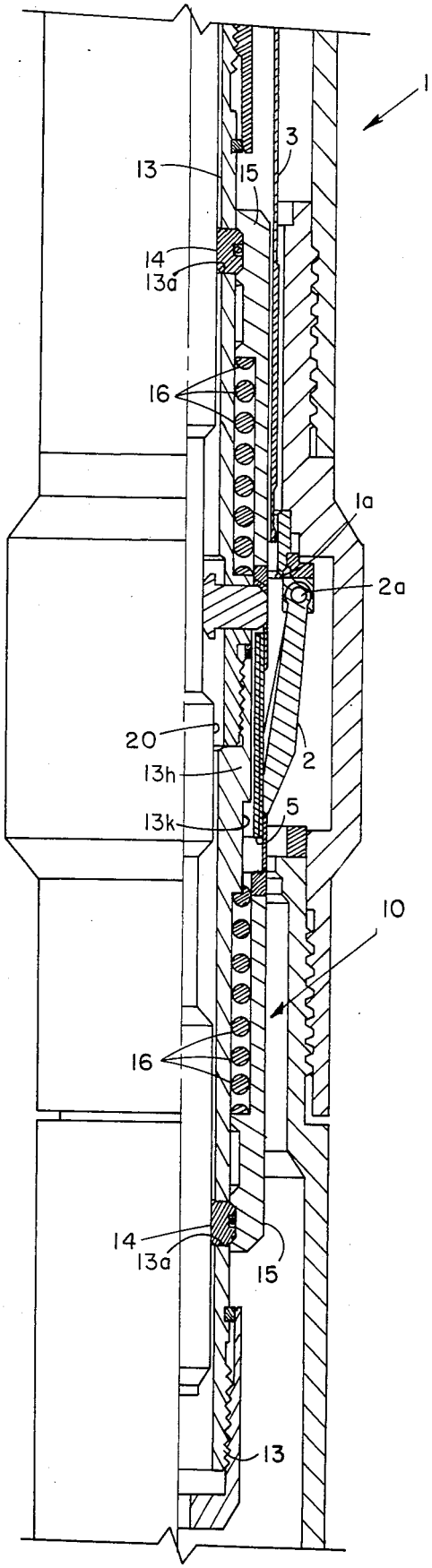

Referring to FIGS. 1A–1B, numeral 1 indicates a conventional safety valve incorporating a shiftably mounted valve element, which in this instance comprises a flapper valve 2 which is transversely pivotally mounted in the safety valve 1 to cooperate with an annular, downwardly facing seating surface 1*a*. Flapper valve 2 is spring urged to its closed position and thus provides a barrier to pressured fluid flow from beneath the valve upwardly through the safety valve to the surface.

The safety valve assemblage 1 is further provided with an actuating sleeve 3 which is operated by conventional annular piston means (now shown) from a source of control fluid pressure (not shown) to move downwardly and effect the shifting of the flapper valve 2 about its pivot pin 2*a* to its open position relative to the conduit bore. In all of the drawings, the actuating sleeve 3 is shown in its position corresponding to the closing of the flapper valve 2, although it should be recognized that in the event of failure of the fluid pressure actuating system for the sleeve 3, or the return spring conventionally provided therefor, it is possible that the actuating sleeve may be disposed in a fully downward or partially downward position relative to the flapper valve 2 and thus be disposed radially adjacent to the flapper valve 2.

Figure 4A:
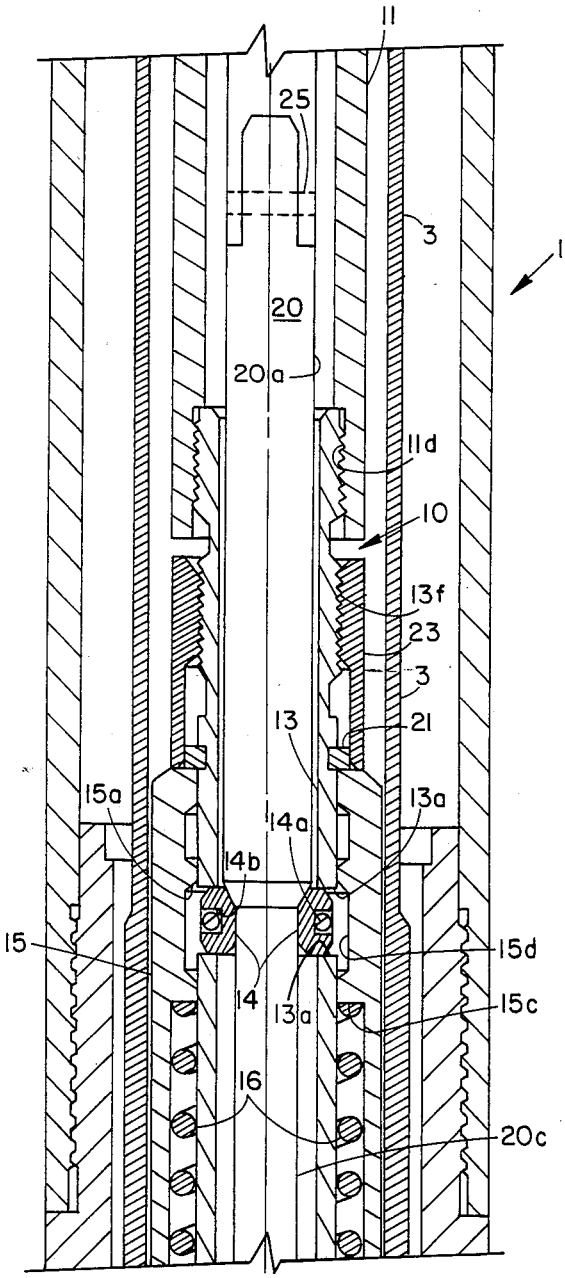
FIGS. 4A and 4B are respectively views similar to FIGS. 3A and 3B but showing the position of the elements following additional upward movement of the mandrel sufficient to release the locking lugs from the spiral retaining sleeves, permitting the contracted locking spring band to expand into engagement with the flapper valve to hold such valve in an open position.
Figure 4B:
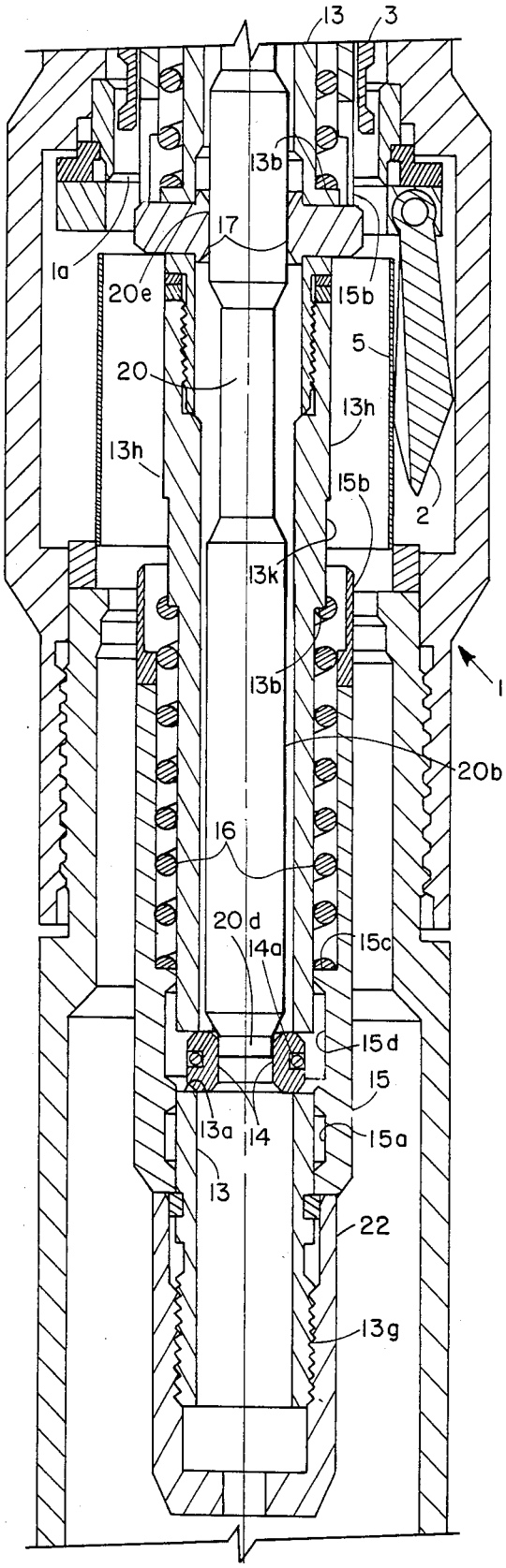

A lock open device embodying this invention comprises a cylindrical band of spring metal, such as spiral spring 5, which in its operative position shown in FIG. 4B, is disposed radially adjacent to the flapper valve 2 and expanded to hold the flapper valve 2 in its substantially vertical, open position. In its expanded position, spring element 5 may constitute a C-ring.

The insertion of the locking spring band 5 in an operative position relative to the shiftable valve 2 is accomplished by an insertion tool assemblage 10. Such assemblage conventionally comprises an upper tubular assemblage 11 surrounding a central mandrel 20. The upper tubular assemblage 11 is provided at its upper end with threads (not shown) for conventional engagement with the lower end of a tubing string (not shown).

Additionally, a conventional lock mechanism 30 is mounted on the upper tubular assemblage 11. Such assemblage cooperates with an internal no-go shoulder 1*b* formed in the bore of the safety valve 1 and also includes a plurality of radially shiftable locking dogs 31 which are movable radially outwardly in conventional fashion to engage an annular latching recess 1*c* provided above the no-go shoulder 1*b*. The construction and operation of lock 30 is entirely conventional and hence will not be further described. In any event, the lock 30 functions to position the upper tubular assemblage 11 and all of the apparatus depending therefrom in a fixed relationship to the no-go shoulder 1*b*, thus assuring that the lock open valve element to be inserted in the safety valve will be properly positioned in alignment with respect to the flapper valve 2.

Figure 2A:
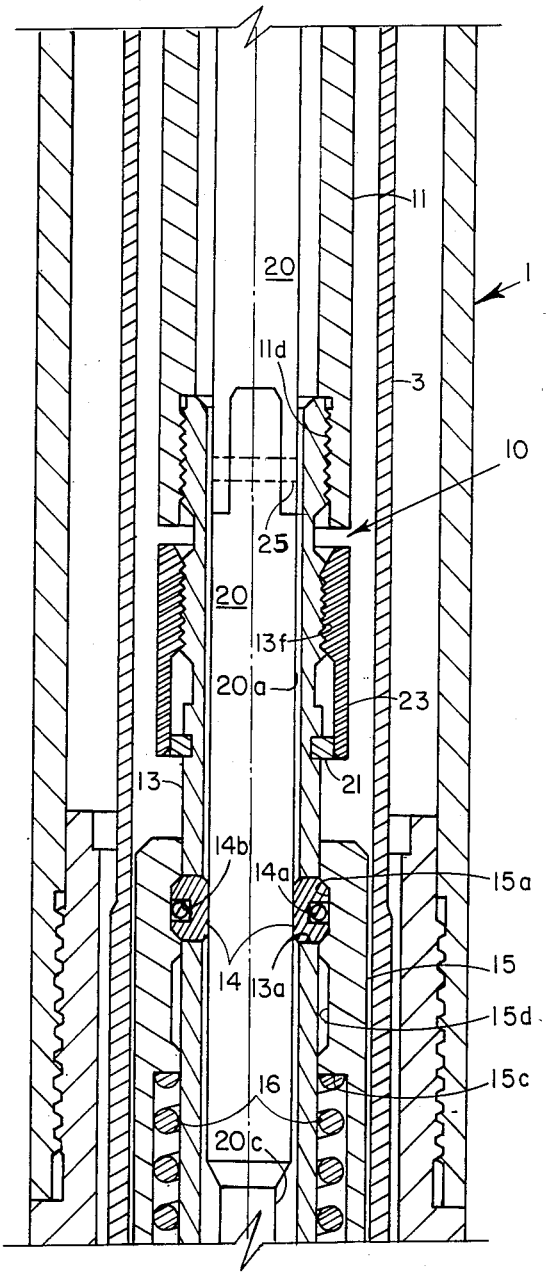
FIGS. 2A and 2B collectively constitute an enlarged scale sectional view of a portion of FIGS. 1A and 1B.
Figure 2B:
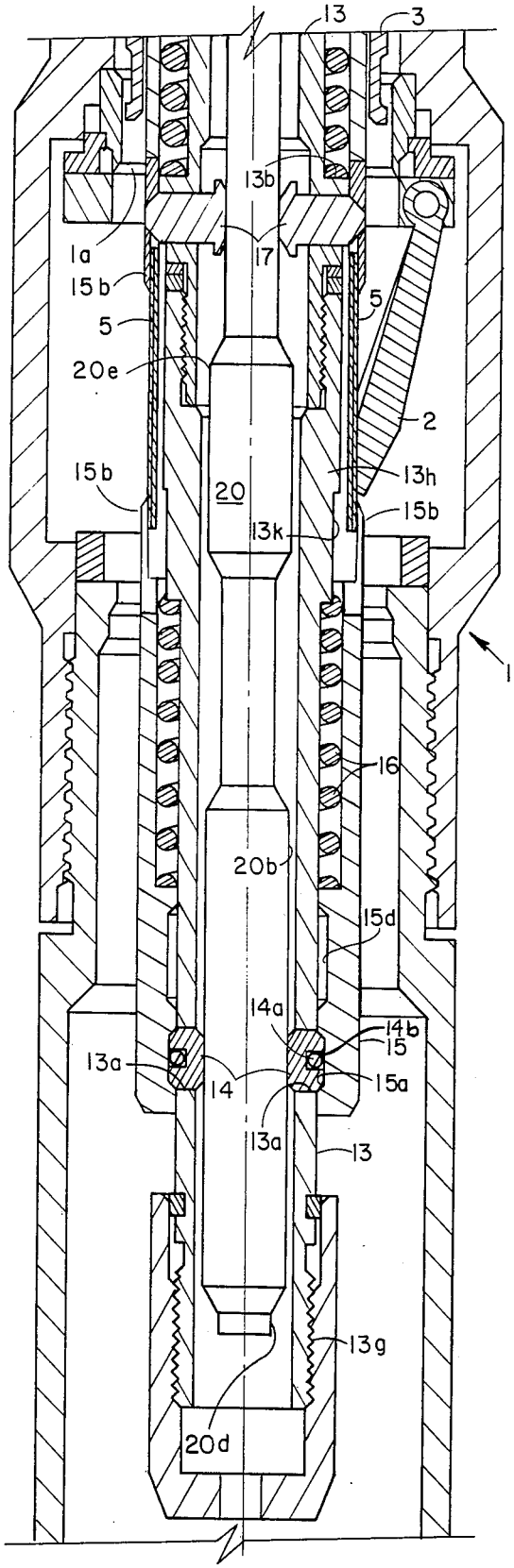
Figure 3A:
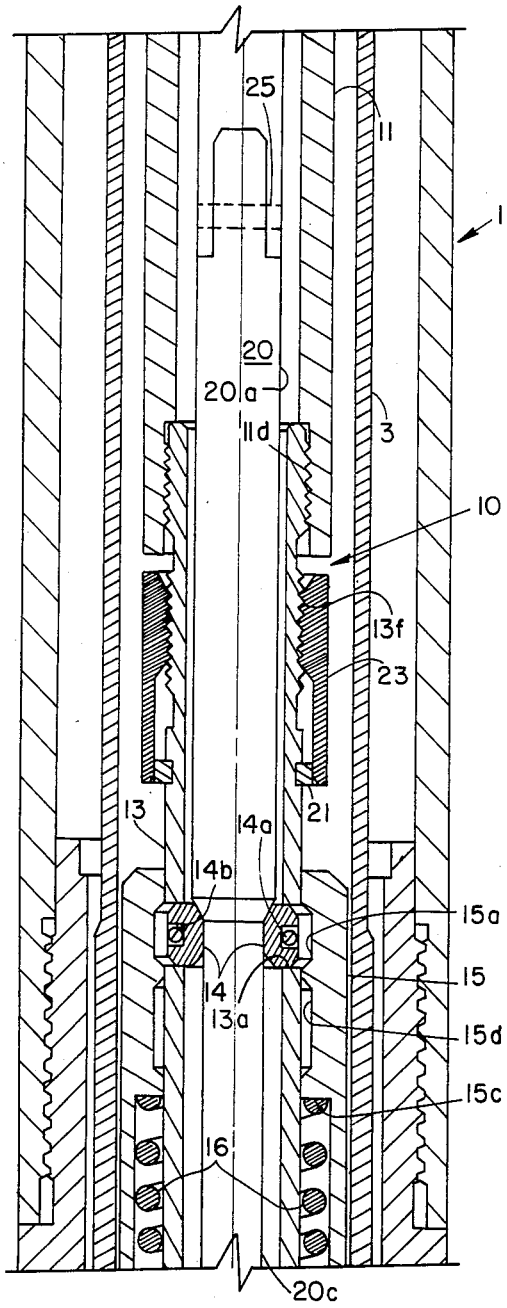
FIGS. 3A and 3B are views respectively similar to FIGS. 2A and 2B with the operative portions of the well insertion tool shown in the positions occupied during the initial upward movement of the mandrel to effect the outward displacement of the positioning lugs.
Figure 3B:
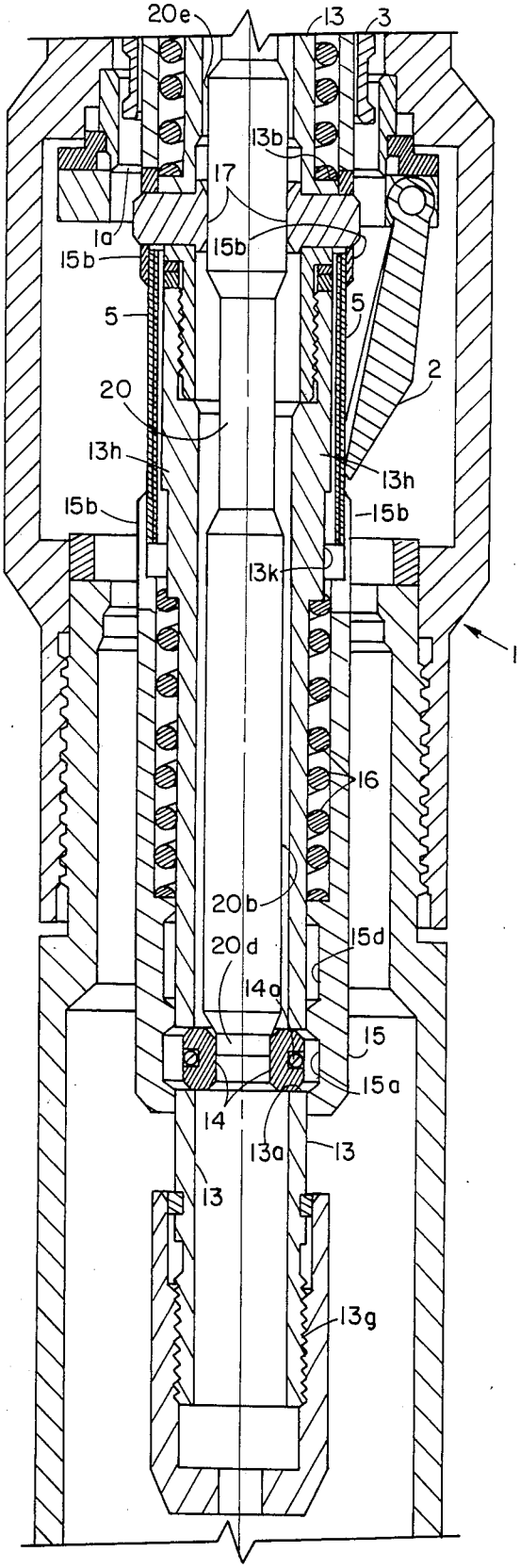

For run-in purposes, central mandrel 20 is secured to the latch assembly by suitable shear pins (not shown). The outer housing 11 of the insertion tool is threadably connected by threads 11*d* to the upper end of an intermediate sleeve assembly 13 which extends to the lowermost portions of the insertion tool 10. Intermediate sleeve assembly 13 is provided with two axially spaced sets of peripherally spaced apertures 13*a* for shiftably mounting an equal plurality of locking lugs 14. Lugs 14 in turn cooperate with internal annular recesses 15*a* provided in the end of two slidable retaining sleeves 15. Locking lugs 14 are urged inwardly by a spring 14*a* which lies in a groove 14*b* provided on each lug (FIGS. 2A and 2B).

Upper and lower retaining sleeves 15 are axially spaced apart and have slots defining axially protruding sections 15*b* constructed to respectively overlap the axial ends of a peripherally contracted spiral locking spring hand 5 to permit the band to be freely inserted within the bore of the safety valve 1. The retaining sleeves 15 are divergently axially biased in a direction to release the band 5 by a compressed springs 16 which operate between internal shouder 15*c* provided on the respective retaining sleeve 15 and an end shoulder 13*b* of radially enlarged portion 13*h* of the intermediate sleeve assembly 13 formed by the threaded juncture of a lower sleeve extension 13*k* to the upper portion of sleeve assembly 13.

The retaining lugs 14 are held in their latching position relative to the retaining sleeves 15 respectively by radially enlarged surface portions 20*a* and 20*b* (FIGS. 2A and 2B) provided on the mandrel 20. In the run-in position of the tool 10, the enlarged portions 20*a* and 20*b* are positioned in engagement with the retaining lugs 14. Thus, a substantial upward movement of the mandrel 20 relative to the outer housing 11, and hence relative to the intermediate sleeve assembly 13, will move the enlarged mandrel portions 20*a* and 20*b* out of engagement with the inner surfaces of the retaining lugs 14, permitting such lugs to fall into radial recesses 20*c* and 20*d* respectively provided on the mandrel 20, and thus release the retaining sleeves 15 for movement under the bias of springs 16 to an axially spaced apart position, thus releasing the ends of the contracted spiral spring band 5 and permitting it to peripherally expand to the position shown in FIG. 4B wherein the flapper valve 2 is held snugly in its outermost, vertical position. One or more alignment screws (not shown) affixed to intermediate sleeves 13 above and below spring element 5 extend through the slots defining axially protruding sections 15*b* on retainer sleeves 15 to maintain rotational alignment during movement of retaining sleeves 15. The alignment screws are angularly displaced from the sectional views depicted herein and therefore do not appear.

The spring induce axial movements of the retaining sleeves 15 are respectively limited by stop sleeves 22 and 23 which are respectively threadably secured to threaded portions 13*f* and 13*g* provided on the intermediate sleeve 13.

In their extreme positions, illustrated in FIG. 4A, the retaining sleeves 15 respectively abut the stop sleeves 22 and 23 and, in that position, an internal recessed bore surface portion 15*d* of each retaining sleeve 15 overlies the locking lugs 14, thus assuring that such lugs are retained in the assemblage during the subsequent retrieval of the insertion tool assemblage 10.

The insertion tool 10 can than be removed from the safety valve 1 and the shiftable valve element 2 of the safety valve 1 will be permanently locked in its open position by the expanded spring band 5, without in any manner restricting the flow passage through the safety valve.

In order to prevent the release of the spirally contracted locking band 5 when the actuating sleeve 3 is in its proper position, namely, radially adjacent to the flapper valve 2, a plurality of positioning lugs 17 are provided which are radially slidably mounted in the enlarged portion 13*h* of the intermediate sleeve assembly 13. The positioning lugs 17 cooperate with a radially enlarged surfaces 20*e* provided on the mandrel 20 and are shifted outwardly by such radially enlarged surface by upward movement of the mandrel 20 prior to the recessed surfaces 20*c* and 20*d* being positioned to receive the retaining lugs 14. Lugs 17 are positioned within slots defined between axially protruding sections 15*b* on retaining sleeve 15.

In normal use, the run-in tool is lowered into the well to open the valve 2, with the valve actuating sleeve 3 remaining in its unactuated upper position. In the event that the actuating sleeve 3 is in an improper position radially adjacent to the path of expansion of the spiral locking band 5, the positioning lugs 17 will abut the inner surface of the actuating sleeve 3 and prevent any further upward movement of the lower portion of the mandrel 20. Additional sets of positioning lugs similar to lugs 17 can be located at other axial positions on the lock-open tool. For example, positioning lugs may be located immediately below the spring element 5. Of course cooperable recesses and radially enlarged surfaces must be added to the mandrel. These additional axial sets may be added to insure that positioning lugs at a single axial location do not expand at an unanticipated position on the bore of the conduit into unanticipated radial opening.

A shear pin 25 is provided between upper and lower portions of mandrel 20 to permit the separation of the mandrel in the event that the positioning lugs 17 cannot be advanced outwardly. Thus, when the severed insertion tool 10 is returned to the surface, the operator will know immediately that the actuating sleeve 3 was improperly positioned, hence, the lower portions of the mandrel 20 remaining in the well conduit can be retrieved in conventional fashion, and proper steps taken to effect the correct positioning of the actuating sleeve 3 prior to reinserting the insertion tool and releasing the expandable locking band.

From the foregoing description, it is apparent that provision must be made for relative upward movement of the mandrel 20 with respect to the outer housing 11. This may be provided in conventional fashion through the utilization of a wireline or a fluid pressure actuator for the mandrel 20.

It will be readily apparent to those skilled in the art that the method employed in the aforedescribed procedure has many applications beyond that of inserting a locking band to hold a flapper valve in an open position. Broadly speaking, the method can be employed to insert a peripherally expandable band into any desired location within the bore of a well conduit or well tool. The same sequence of steps is employed, namely, the peripherally expandable spring band is wound or peripherally contracted about a run-in tool which includes an axially shiftable mandrel. The edges of the contracted expandable band are secured by shiftable latches. The latches in turn are shiftable to a disengagable position by axial movement of the mandrel. Thus, the contracted band may be run into the bore of a well conduit, positioned wherever desired, and release of the expandable band to expand outwardly against the walls of the conduit accomplished by axial movement of the mandrel. Thereafter, the remaining portion of hte tool may be removed from the well bore.

Although the invention has been described in terms of specified embodiments which are set forth in detail, it should be understood that this is by illustration only and that the invention is not necesasarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for permanently locking a shiftable valve in a well conduit in an open position comprising: a mandrel; a resiliently expandable peripheral lock element surrounding said mandrel, shiftable latch means mounted on said mandrel to retain said lock element in a peripherally contracted position; and means operable by movement of said mandrel for shifting said latch means to a non-retaining position relative to said contracted lock element, thereby permitting said resilient lock element to peripherally expand to lock said shiftable valve in the open position.

2. Apparatus for permanently locking a shiftable valve in a well conduit in an open position comprising a tool assemblage insertable in the well conduit on a tool string; said assemblage comprising a mandrel suspended from the tool string; a resiliently expandable peripheral lock element surrounding said mandrel, shiftable latch means mounted on said mandrel to retain said lock element in a peripherally contracted position during run-in to a position opposite the open position of said valve; and means operable by movement of said mandrel for shifting said latch means to a non-retaining position relative to said contracted lock element, thereby permitting said resilient lock element to peripherally expand into locking engagement with said open valve.

3. The apparatus of claim 2 wherein said shiftable valve comprises a flapper valve.

4. The apparatus of claim 2 wherein said lock element comprises a spiral band of spring metal.

5. The apparatus of claim 2 wherein said shiftable latch means comprises a pair of sleeves respectively surrounding said mandrel at opposite axial ends of said lock element, the ends of said sleeves securing said lock element in said contracted position.

6. The apparatus of claim 5 wherein said means operable by movement of said mandrel for shifting said latch means comprises resilient means biasing each of said sleeves to a releasing position relative to said lock element; and locking lugs respectively operatively connected to said sleeves to restrain same against said spring bias and releasable by movement of said mandrel relative to said sleeves.

7. The apparatus of claim 6 further comprising an intermediate sleeve disposed between said mandrel and each of said locking element and sleeves; said locking lugs being mounted in said intermediate sleeve; and releasable means for securing said intermediate sleeve to the conduit; thereby permitting axial movement of said mandrel relative to said intermediate sleeve to release said locking lugs.

8. Apparatus for permanently locking a shiftable valve in a well conduit, said shitable valve having an axially shiftable actuating sleeve, comprising: a tool assemblage entirely separate from said valve insertable in the well conduit on a tool string; said assemblage comprising a mandrel suspended from the tool string; a resiliently expandable peripheral lock element surrounded said mandrel, shiftable latch means mounted around said mandrel to retain said lock element in a peripherally contracted position during run-in to a position opposite the open position of said valve; a first means operable by axial movement of said mandrel in one direction to detect whether said axially shiftable actuating sleeve is out of the expansion path of said peripherally expandable lock element; and a second means operable by further movement of said mandrel in said one direction for shifting said latch means to a non-retaining position relative to said peripheral lock element, thereby permitting said lock element to expand into locking engagement with said open valve.

9. The apparatus of claim 8 wherein said shiftable valve comprises a flapper valve.

10. The apparatus of claim 8 wherein said lock element comprises a cylindrical band of spring metal.

11. The apparatus of claim 8 wherein said lock element comprises a spiral band of spring metal.

12. The apparatus of claim 8 wherein said shiftable latch means comprises a pair of sleeves respectively surrounding said mandrel at opposite axial ends of said lock element and having axial extensions securing said lock element in said contracted position.

13. The apparatus of claim 12 wherein said second means operable by movement of said mandrel for shifting said latch means comprises resilient means biasing each of said sleeves to a releasing position relative to said lock element; and locking lugs respectively operatively connected to said sleeves to restrain same against said spring bias and releasable by movement of said mandrel relative to said sleeves.

14. The apparatus of claim 13 wherein said first means responsive to axial movement of said mandrel comprises a plurality of peripherally spaced detecting lugs radially outwardly shiftable by said axial movement of said mandrel to engage the actuating sleeve when the actuating sleeve is disposed in the path of radial expansion of said expandable locking element; thereby blocking further axial movement of said mandrel and preventing release of said expandable locking element.

15. The apparatus of claim 14 further comprising an intermediate sleeve disposed between said mandrel and each of said locking element and retaining sleeves; said intermediate sleeve having two axially spaced sets of apertures for mounting said locking lugs, and a third set of apertures for mounting said detecting lugs; and releasable means for securing said intermediate sleeve to the conduit, thereby permitting initial axial movement of said mandrel relative to said intermediate sleeve to release said detecting lugs, and further axial movement of said mandrel to release said locking lugs.

16. The method of permanently depositing a peripherally expandable element within the bore of a well tool comprising the steps of:

(1) Peripherally contracting the peripherally expandable element about a tubular run-in tool, said run-in tool including an axially shiftable mandrel;

(2) Securing each axial end of the contracted peripherally expandable band by a separate axially shiftable latch; and (3) Concurrently moving saift shiftable latches by a single axial movement of said mandrel to simultaneously release both axial ends of the peripherally expandable band to expand into the desired position in the tool bore and permit withdrawal of the run-in tool.

17. The method of locking a shiftable valve in an open position in a well conduit by a peripherally expandable band comprising the steps of:

1. Peripherally contracting the peripherally expandable band about a tubular run-in tool;
2. Detachably securing the peripherally expandable band in a contracted state on the run-in tool during run-in to the desired location in the well tool bore; and
3. Releasing the peripherally expandable band from the run-in tool to expand into the desired position on the tool bore and permit withdrawal of the run-in tool.

18. The method of claim 17 further comprising the step of shifting the valve to the open position by downward movement of the run-in tool prior to release of the expandable head.

19. The method of locking a shiftable valve in an open position in a well conduit by a peripherally expandable band comprising the steps of:

1. Peripherally contracting the peripherally expandable band about a tubular run-in tool, said run-in tool including an axially shiftable mandrel;
2. Securing each axial end of the contracted peripherally expandable band by a shiftable latch;
3. Running in the contracted band to a position radially adjacent the open shiftable valve; and
4. Concurrently moving said latches by axial movement of said mandrel to simultaneously release the peripherally expandable band to expand into engagement with the open shiftable valve and permit withdrawal of the run-in tool.

20. The method of claim 19 further comprising the step of shifting the valve to the open position by downward movement of the run-in tool prior to release of the expandable head.

* * * * *